US006978916B2

(12) United States Patent
Smith

(10) Patent No.: US 6,978,916 B2
(45) Date of Patent: Dec. 27, 2005

(54) METERING VALVE FOR AEROSOL CONTAINER

(75) Inventor: Jeremy P. Smith, Loudon, NH (US)

(73) Assignee: Summit Packaging Systems, Inc., Manchester, NH (US)

( * ) Notice: Subject to any disclaimer, the term of this patent is extended or adjusted under 35 U.S.C. 154(b) by 48 days.

(21) Appl. No.: 10/454,309

(22) Filed: Jun. 4, 2003

(65) Prior Publication Data

US 2003/0230603 A1 Dec. 18, 2003

Related U.S. Application Data

(63) Continuation-in-part of application No. 10/174,407, filed on Jun. 17, 2002.

(51) Int. Cl.[7] ..... B65D 83/06

(52) U.S. Cl. ..... 222/402.2; 222/402.1; 222/402.16; 222/402.24; 141/20

(58) Field of Search ..... 222/402.1, 402.16, 222/402.2, 402.24; 141/20

(56) References Cited

U.S. PATENT DOCUMENTS

| | | | | |
|---|---|---|---|---|
| 2,631,814 | A | 3/1953 | Abplanalp | 251/137 |
| 2,701,163 | A | 2/1955 | Teller et al. | 299/95 |
| 2,723,055 | A | 11/1955 | Beard, Jr. | 222/394 |
| 2,856,235 | A | 10/1958 | Ward | 299/95 |
| 2,867,356 | A | 1/1959 | Thomas | 222/148 |

(Continued)

FOREIGN PATENT DOCUMENTS

| | | | |
|---|---|---|---|
| DE | 198 35 273 | 3/1999 | B65D/83/54 |
| DE | 201 14 780 | 1/2002 | B65D/83/54 |
| EP | 0 352 915 | 1/1990 | B65D/83/54 |
| EP | 0 350 376 B1 | 1/1993 | B65D/83/54 |
| EP | 0 798 233 A2 | 10/1997 | B65D/83/44 |
| FR | 1 162 829 A | 9/1958 | |
| FR | 2 767 801 | 3/1999 | B65D/83/54 |
| WO | WO 90/12743 | 11/1990 | |
| WO | 92/07777 | 5/1992 | B65D/83/14 |
| WO | 92/11190 | 7/1992 | B65D/83/14 |
| WO | 00/26116 | 5/2000 | B65D/83/14 |
| WO | 02/10037 | 2/2002 | B65D/83/54 |

*Primary Examiner*—Kenneth Bomberg
(74) *Attorney, Agent, or Firm*—Davis & Bujold, P.L.L.C.

(57) ABSTRACT

A metering valve assembly comprising a ferrule and a valve housing defining an internal cavity. The valve housing accommodates an annular flange and a compression spring therein with a valve gasket closing the internal cavity. The valve housing is attached to the ferrule such that a stem portion of the valve stem protrudes through apertures provided in both the valve gasket and the ferrule. A stem portion has a discharge passageway which is normally closed by the valve gasket. Either an undersurface of the annular flange or a mating surface of the valve housing is provided with a compressible sealing member while the other is provided with an annular edge. The compressible sealing member and the annular edge form a seal therebetween, when the valve stem is sufficiently depressed, to partition the interior cavity into a metering chamber and a separate filling chamber whereby product may only be dispensed solely from the metering chamber when a product flow path is established.

20 Claims, 11 Drawing Sheets

U.S. PATENT DOCUMENTS 2,932,432 A * 4/1960 Beard, Jr. ..... 222/402.2
2,998,168 A * 8/1961 Waldherr ..... 222/402.2
3,055,560 A 9/1962 Meshberg ..... 222/394
3,073,489 A 1/1963 Friedman ..... 222/394
3,158,298 A 11/1964 Briechle ..... 222/394
3,180,374 A 4/1965 Muller ..... 141/20
3,186,605 A 6/1965 Potoczky ..... 222/394
3,219,069 A 11/1965 Kuffer ..... 141/20
3,313,459 A * 4/1967 Mizuguchi ..... 222/402.2
3,319,669 A 5/1967 Abplanalp ..... 141/20
3,375,957 A 4/1968 Kuffer ..... 222/402.16
3,567,081 A 3/1971 Meshberg ..... 222/402.17
3,581,946 A 6/1971 Meshberg ..... 222/136
3,581,958 A 6/1971 Meshberg ..... 222/542
3,583,606 A 6/1971 Ewald ..... 222/402.18
3,583,608 A 6/1971 Green ..... 222/402.24
3,589,571 A 6/1971 Green ..... 222/402.24
3,612,361 A 10/1971 Ewald ..... 222/402.18
3,637,114 A 1/1972 Meshberg ..... 222/135
3,651,997 A 3/1972 Venus, Jr. ..... 222/402.16
3,756,465 A 9/1973 Meshberg ..... 222/61
3,777,946 A 12/1973 Livingstone ..... 222/402.2
3,791,561 A 2/1974 Ewald ..... 222/396
3,813,013 A 5/1974 Kotuby et al. ..... 222/402.2
3,845,887 A 11/1974 Meuresch et al. ..... 222/402.16
3,848,778 A 11/1974 Meshberg ..... 222/402.11
3,858,768 A 1/1975 Meshberg ..... 222/180
3,920,158 A 11/1975 Meshberg ..... 222/135
3,927,806 A 12/1975 Meshberg ..... 222/402.12
3,949,910 A 4/1976 Focht ..... 222/321
3,949,912 A 4/1976 Meshberg et al. ..... 222/394
3,986,248 A 10/1976 Meshberg et al. ..... 29/458
4,008,830 A 2/1977 Meshberg ..... 222/95
4,015,752 A 4/1977 Meuresch et al. ..... 222/402.16
4,015,757 A 4/1977 Meuresch et al. ..... 222/402.16
4,034,899 A 7/1977 Meshberg ..... 222/321
4,061,247 A 12/1977 Meshberg ..... 222/1
4,062,517 A 12/1977 Jones ..... 251/322
4,078,705 A 3/1978 Butcher ..... 222/402.24
4,113,145 A 9/1978 Meshberg ..... 222/1
4,135,648 A 1/1979 White ..... 222/402.2
4,230,242 A 10/1980 Meshberg ..... 222/321
4,271,875 A 6/1981 Meshberg ..... 141/3
4,311,255 A 1/1982 Meshberg ..... 222/183
4,324,351 A 4/1982 Meshberg ..... 222/402.11
4,362,257 A 12/1982 Shay ..... 222/402.2
4,389,003 A 6/1983 Meshberg ..... 222/321
4,413,755 A 11/1983 Brunet ..... 222/402.2
4,427,137 A 1/1984 Dubini ..... 222/402.2
4,434,914 A 3/1984 Meshberg ..... 222/153
4,435,135 A 3/1984 Knickerbocker ..... 417/511
4,441,634 A 4/1984 Meshberg ..... 222/402.16
4,456,153 A 6/1984 Meshberg ..... 222/321
4,457,454 A 7/1984 Meshberg ..... 222/95
4,457,455 A 7/1984 Meshberg ..... 222/105
4,577,784 A 3/1986 Brunet ..... 222/402.2
4,597,512 A 7/1986 Wilmot ..... 222/402.2
4,696,415 A 9/1987 Meshberg ..... 222/82
4,702,400 A 10/1987 Corbett ..... 222/402.2
4,735,347 A 4/1988 Schultz et al. ..... 222/321
4,811,868 A 3/1989 Nitta ..... 222/462.2
4,842,168 A 6/1989 Bougamont et al. ..... 222/402.2
4,858,790 A 8/1989 Howlett ..... 222/402.2
4,867,352 A 9/1989 Meshberg ..... 222/402.16
4,895,279 A 1/1990 Schultz ..... 222/321
4,942,985 A 7/1990 Schultz ..... 222/376
4,953,759 A 9/1990 Schmidt ..... 222/402.2
RE33,552 E 3/1991 Bougamont et al. ... 222/402.16
5,027,985 A 7/1991 Abplanalp ..... 222/402.1
5,037,013 A 8/1991 Howlett ..... 222/402.2
5,085,351 A 2/1992 Martin ..... 222/287
5,100,029 A 3/1992 Meshberg ..... 222/148
5,158,211 A 10/1992 Meshberg ..... 222/153
5,169,038 A 12/1992 Di Giovanni ..... 222/402.2
5,183,186 A 2/1993 Delaney, Jr. ..... 222/211
5,222,636 A 6/1993 Meuresch ..... 222/321
5,263,616 A 11/1993 Abplanalp ..... 222/402.13
5,265,771 A 11/1993 Meshberg ..... 222/207
5,273,191 A 12/1993 Meshberg ..... 222/105
5,290,539 A 3/1994 Marecki ..... 424/45
5,301,846 A 4/1994 Schmitz ..... 222/211
5,305,810 A 4/1994 Meshberg ..... 141/374
5,310,112 A 5/1994 Meshberg ..... 222/482
5,318,205 A 6/1994 Delaney, Jr. ..... 222/211
5,343,901 A 9/1994 Meshberg ..... 141/2
5,348,199 A 9/1994 Smith
5,363,992 A 11/1994 Meshberg ..... 222/309
5,363,993 A 11/1994 Mascitelli et al. ..... 222/321
5,370,862 A 12/1994 Klokkers-Bethke et al. .. 424/47
5,392,962 A 2/1995 Meshberg ..... 222/321
5,433,343 A 7/1995 Meshberg ..... 222/25
5,460,207 A 10/1995 Meshberg ..... 141/1
5,516,006 A 5/1996 Meshberg ..... 222/25
5,593,064 A 1/1997 Meshberg ..... 222/39
5,620,113 A 4/1997 Meshberg ..... 222/1
D383,382 S 9/1997 Meshberg ..... D9/300
5,667,104 A 9/1997 Meshberg ..... 222/143
5,702,031 A 12/1997 Meshberg et al. ..... 222/1
D402,542 S 12/1998 Meshberg ..... D9/300
5,875,932 A 3/1999 Meshberg ..... 222/153.13
5,906,046 A 5/1999 Abplanalp et al. ..... 29/890.124
5,918,778 A 7/1999 Schultz ..... 222/321.7
5,938,085 A 8/1999 Conroy et al. ..... 222/402.2
RE36,410 E 11/1999 Meshberg ..... 141/2
5,975,378 A 11/1999 Bayer ..... 222/402.24
6,003,737 A 12/1999 Mascitelli ..... 222/321.2
6,006,745 A 12/1999 Marecki ..... 128/200.23
6,016,974 A 1/2000 Mascitelli ..... 239/333
6,039,306 A 3/2000 Pericard et al. ..... 251/353
6,047,856 A 4/2000 Meshberg et al. ..... 222/1
6,047,946 A 4/2000 Kolanus ..... 251/89
6,092,698 A 7/2000 Bayer ..... 222/402.25
6,126,042 A 10/2000 Meshberg ..... 222/321.4
6,131,777 A 10/2000 Warby ..... 222/402.2
6,170,713 B1 1/2001 Schultz ..... 222/321.2
6,170,717 B1 1/2001 Di Giovanni et al. ... 222/402.2
6,202,900 B1 3/2001 Tsutsui et al. ..... 222/402.2
6,247,613 B1 6/2001 Meshberg ..... 222/1
6,254,104 B1 7/2001 Hafner ..... 277/590
6,267,304 B1 7/2001 Schultz ..... 239/327
6,296,155 B1 10/2001 Smith
6,357,633 B1 3/2002 Zimmerhackel et al. . 222/402.1
6,375,046 B1 4/2002 Alleard et al. ..... 222/386.5
6,382,463 B2 5/2002 Meshberg ..... 222/1
6,394,321 B1 5/2002 Bayer ..... 222/402.24

* cited by examiner

METERING VALVE FOR AEROSOL CONTAINER

This application is a Continuation-in-Part of Ser. No. 10/174,407 filed Jun. 17, 2002.

FIELD OF THE INVENTION

The present invention relates to a metering valve assembly for dispensing a premeasured quantity of a product from an aerosol container once the stem of the aerosol valve is sufficiently depressed.

BACKGROUND OF THE INVENTION

A number of metering valves are currently available in the market place. Most of these currently available metering valves utilize a ball or some other additional component which has to be separately installed in the valve housing to ensure proper metering of a desired quantity of an aerosol product from the valve assembly upon sufficient actuation or depression of the stem. The installation of this additional component, during manufacture of the aerosol valve, generally increases the production costs as well as the inspection costs associated with manufacture of the aerosol valve. Moreover, if the additional component is not properly installed or is omitted from the valve assembly for some reason, the aerosol valve will malfunction. Accordingly, an inspection step is generally required, following installation of the additional component, to confirm that the additional component was, in fact, properly installed within the aerosol valve.

Another drawback associated with prior art metering valves is that such valves have a tendency to "throttle". That is, due to a poor or an improper valve design, it is possible for an operator to partially depress the valve stem and establish a product flow path from the interior cavity of the aerosol container through the metering valve and out through a spray button or an actuator affixed to the stem of the aerosol valve, prior to the valve stem sealing the inlet to the valve housing, so that product may be continuously discharged out through the aerosol valve. As a result of such "throttling", the operator is able to dispense a continuous discharge of product from the aerosol container via the metering valve rather than meter a desired amount. This results in the inadvertent discharge of excess product from the aerosol container which is wasteful and generally to be avoided.

Another prior art design utilizes a frictional sealing fit between two plastic valve components to separate the contents of the container from the metering chamber. This arrangement requires that a valve spring, accommodated by the valve, be sufficiently forceful to overcome the interference fit of this sealing device upon the valve closing sequence. Apart from being subject to size and hardness changes due to immersion in the product, this design mandates extremely close tolerances of the mating components and critical alignment of molded parts during the valve assembly operation. Failure to observe these manufacturing tolerances and alignment criteria leads to an inaccurate metered spray or a valve which will not "shut-off" and thus result in the total release or dispensing of the entire product contents.

SUMMARY OF THE INVENTION

Wherefore, it is an object of the present invention to overcome the above noted drawbacks associated with the prior art aerosol metering valves.

Another object of the present invention is to minimize the amount of separate components that must be separately assembled, during manufacture of the valve assembly, to improve the easy of assembly of the metering valve assembly.

Yet another object of the present invention is to provide a metering valve assembly which reliably, consistently and accurately dispenses a desired quantity of the product contents from the metering valve assembly.

A still further object of the present invention is to provide a metering valve assembly which can be reliably manufactured while minimizing the degree of inspection required for manufacture of the metering valve assembly.

A further object of the present invention is to provide a metering valve assembly which prevents inadvertent "throttling" of the metering valve assembly by an operator.

Yet another object of the present invention is to provide a metering valve assembly which is securely affixed to the valve housing and, following insert of the valve housing onto a container, the metering valve assembly establishes a flow path with the internal cavity of the container to facilitate pressuring of the container with the product to be dispensed during the manufacturing process.

The present invention also relates to a ferrule having an aperture formed therein; a valve housing having an inlet provided in a base wall thereof, the valve housing defining an internal cavity which accommodates an annular flange of a valve stem and a compression spring therein, and a valve gasket closing the internal cavity; the valve housing being attached to the ferrule such that a stem portion of the valve stem protrudes through an aperture provided in the valve gasket and through the aperture provided in the ferrule; and the stem portion having a passageway formed therein communicating with a dispensing outlet, and an opposite end of the passageway communicating with at least one radial passageway; and the at least one radial passageway being normally closed by the valve gasket due to the spring normally biasing the valve stem into a closed position; wherein one of an undersurface of the annular flange of the valve stem and a mating surface of the valve housing is provided with a compressible sealing member and the other of the undersurface of the valve stem and the mating surface of the valve housing is provided with an annular sealing edge, and the compressible sealing member and the annular sealing edge form a seal therebetween, when the valve stem is sufficiently depressed, to partition the interior cavity into a metering chamber and a separate filling chamber so that product may be dispensed solely from the metering chamber when a product flow path is established between the metering chamber and the dispensing outlet of the valve stem.

The present invention also relates to a method of metering dispensing of product through a metering valve assembly, the method comprising the steps of: forming an aperture in a ferrule; providing an inlet in a wall of a valve housing and defining, via the valve housing, an internal cavity which accommodates an annular flange of a valve stem and a compression spring therein, and closing the internal cavity by a valve gasket; attaching the valve housing to the ferrule such that a stem portion of the valve stem protrudes through an aperture provided in the valve gasket and through the aperture provided in the ferrule; and forming a passageway in the stem portion which communicates with a dispensing outlet of the metering valve assembly, while an opposite end of the passageway communicates with at least one radial passageway; and normally closing the at least one radial passageway the valve gasket due to the spring normally biasing the valve stem into a closed position; providing one of an undersurface of the annular flange of the valve stem and a mating surface of the valve housing with a compressible sealing member and providing the other of the undersurface of the valve stem and the mating surface of the valve housing with an annular sealing edge, and forming a seal between the compressible sealing member and the annular sealing edge when the valve stem is sufficiently depressed, to partition the interior cavity into a metering chamber and a separate filling chamber, so that product may be dispensed only from the metering chamber when a product flow path is established between the metering chamber and the dispensing outlet of the valve stem.

In the following description and appended drawings, the terms "inward" and "downward" mean toward a lower bottom portion of the respective drawing while the terms "top" and upward" mean toward an upper portion of the respective drawing.

BRIEF DESCRIPTION OF THE DRAWINGS

The invention will now be described, by way of example, with reference to the accompanying drawings in which.

DETAILED DESCRIPTION OF THE INVENTION

Figure 1:
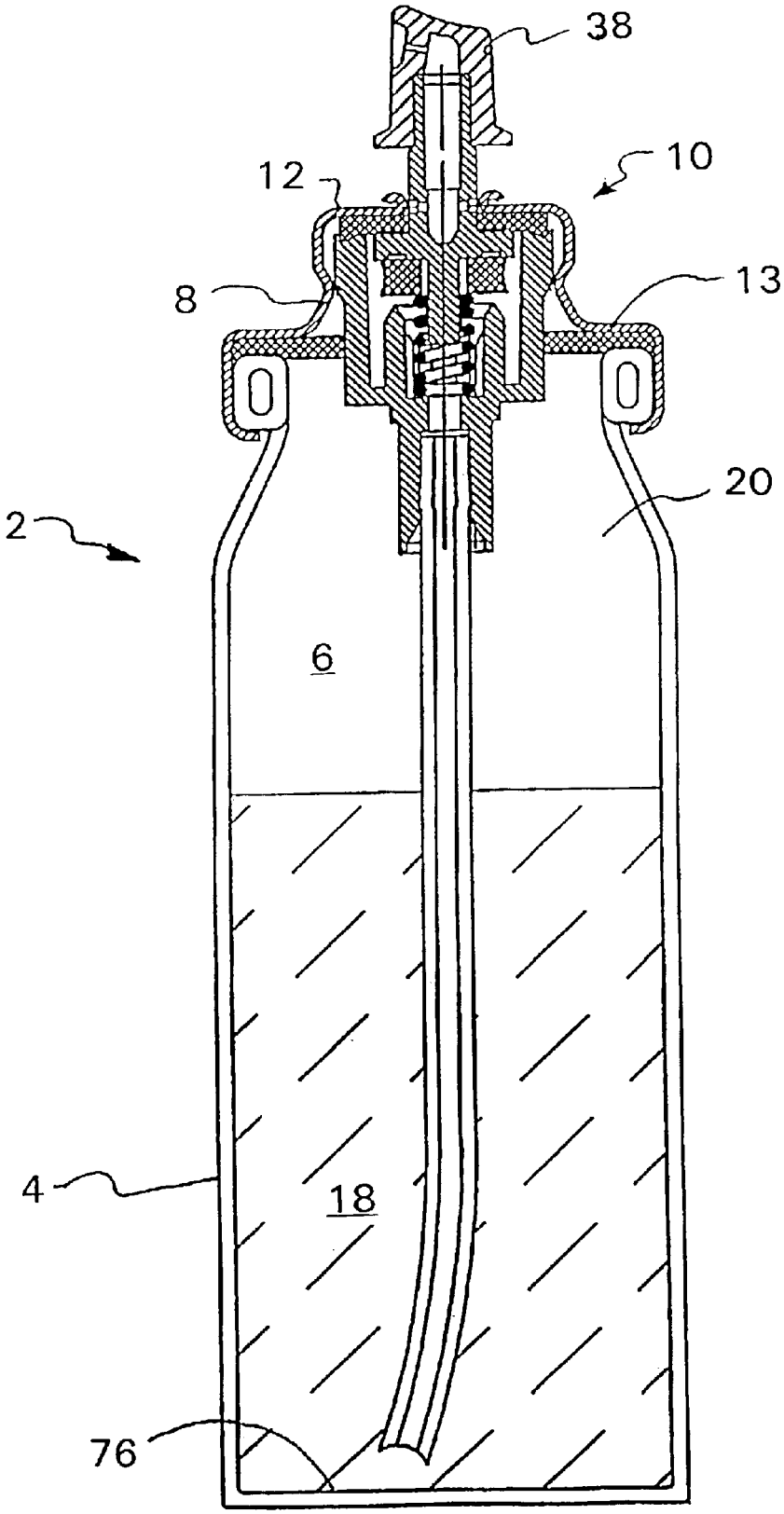
FIG. 1 is a diagrammatic view of a pressurized container containing a metering valve assembly according to the present invention.

Turning first to FIG. 1, an aerosol or pressurizable canister or container 2 is generally shown and it comprises a base container 4, defining a product/propellent interior cavity 6 therein, which has an opening in a top portion of the base container 4 for receiving either a mounting cup or a conventional ferrule 8 (for the sake of simplicity, the term ferrule will be used throughout the remainder of the specification and the claims but it is to be understood that the invention is also applicable for use with a mounting cup). Prior to the ferrule 8 being attached to the base container 4, a metering valve assembly 10, typically comprising a vertical depressible valve, is crimped to a pedestal portion 12 of the ferrule 8 in a conventional manner. Once this has occurred, a ferrule gasket 13 is received by the exterior surface of the metering valve assembly 10 such that an end face of the ferrule gasket 13 abuts with the inwardly facing surface of the ferrule 8. Next, as is conventionally done in the art, the product/propellent interior cavity 6 of the pressurizable container 2 is filled with a desired product to be dispensed 18 as well as a desired propellent 20 to facilitate desired dispensing of the desired product to be dispensed 18 therefrom. Thereafter, the ferrule 8, with the attached metering valve assembly 10 and the ferrule gasket 13, is installed in the opening in the top of the base container 4 and an outer periphery of the ferrule 8 is crimped or otherwise secured to the base container 4, in a conventional manner, to form the pressurizable container 2 in which a surface of the ferrule gasket 13 abuts with the perimeter opening in the top portion of the base container 4 to provide a fluid tight seal therewith. Alternatively, the ferrule 8, with the attached metering valve assembly 10 and the ferrule gasket 13 attached thereto, may be first installed in the opening in the top of the base container 4, prior to filling, and thereafter the product/propellent interior cavity 6 of the pressurizable container 2 is filled with a desired product to be dispensed 18 as well as a desired propellent 20. As both of the above techniques are conventional and well known in the art, a further detailed description concerning the same is not provided.

Turning now to FIGS. 2–4A, a detailed description concerning the first embodiment of the metering valve assembly, according to the present invention, will now be provided. As can be seen in these Figures, the ferrule 8 supports the metering valve assembly 10. The metering valve assembly 10 comprises a valve housing 22 having an internal cavity 24 which supports a lower portion of an upstanding valve stem 26, a compression spring 28 and a valve gasket 30. The valve stem 26 and the compression spring 28 are assembled within the internal cavity 24 of the valve housing 22 and the valve gasket 30 covers the opening of the valve housing 22 and this assembly is then clamped or crimped to the ferrule 8 via a plurality of indentations or crimps, e.g., the plurality of indentations or crimps are formed inwardly from the exterior of the sidewall of the pedestal portion 12 to permanently attach the metering valve assembly 10 to the ferrule 8. The crimping operation forces the valve housing 22 slightly upward, relative to the ferrule 8, to bias and compressively seal the valve gasket 30 against the inwardly facing surface of the ferrule 8 and form a fluid tight seal therebetween. A stem portion 34 of the valve stem 26 protrudes through a central aperture 36 provided in the pedestal portion 12 of the ferrule 8 as well as a central aperture (not numbered) provided in the valve gasket 30 and the stem portion 34 supports an actuator 38 (see FIG. 1). The actuator 38 has a central product inlet or aperture therein which receives or fits over an exterior surface of the stem portion 34. The product inlet, in turn, communicates with a dispensing outlet of the actuator 38 via an actuator passageway, as is well known in the art, to facilitate transfer of the product to be dispensed from the stem portion 34 out through the dispensing outlet of the actuator 38 and into the surrounding environment.

Figure 2A:
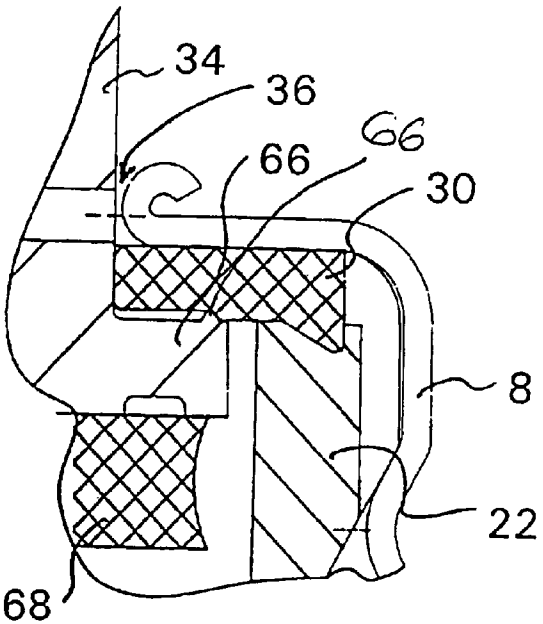
FIG. 2A is an enlarged diagrammatic view of area A of FIG. 2.
Figure 2:
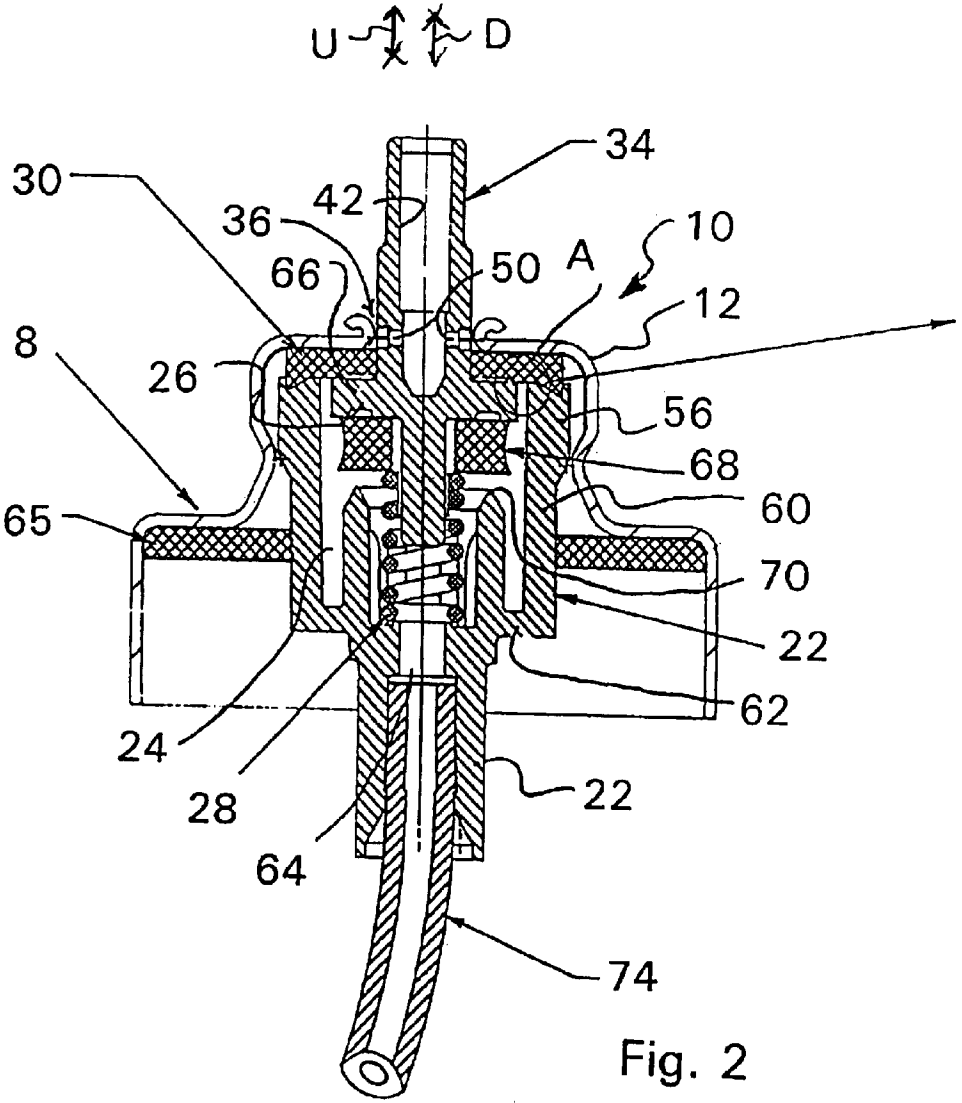
FIG. 2 is a diagrammatic cross-sectional view of a metering valve assembly, according to the present invention, shown in a normally biased closed position.
Figure 3:
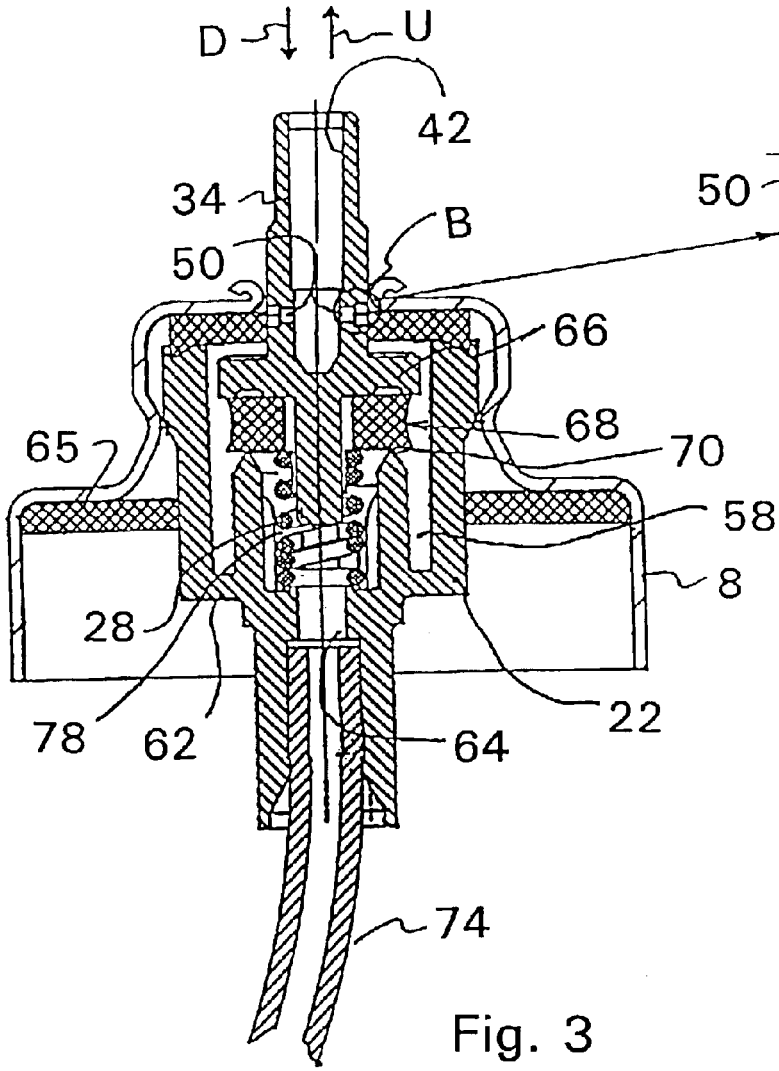
FIG. 3 is a diagrammatic cross-sectional view, of the metering valve assembly of FIG. 2, showing the metering valve assembly in a partially depressed position where the valve stem seals with the annular sealing edge of the valve housing.

The stem portion 34 has a central passageway 42 with a dispensing outlet which communicates with product inlet of the actuator 38. The opposite end of the central passageway 42 communicates with at least one radial passageway 50, and possibly two, three, four or more radial passageways 50 generally equally spaced about the circumference of a lower portion of the stem portion 34 of the valve stem 26. Each one of the radial passageway(s) 50 is normally temporarily blocked from discharging product due to its sealingly engagement with an inwardly facing surface of the valve gasket 30 when the metering valve assembly is both in its normally closed position, as can be seen in FIG. 2, and in its partially closed position, as can be seen in FIG. 3. When the valve stem 26 is substantially completely depressed by an operator (see FIG. 4), the seal between the valve gasket 30 and the at least one radial passageway(s) 50 is broken and a product flow path is established from a metering chamber 58, formed within the valve housing 22, through the at least one radial passageway(s) 50 and out through the central passageway 42 and the actuator 38 into the surrounding environment.

The valve housing 22 generally has a thickened mouth 56. The valve housing 22 also includes a cylindrical side wall 60 and a generally planar base wall 62 which is provided with a housing inlet 64. During the crimping operation with the pedestal portion 12, the plurality of indentations or crimps engage a lower portion of the thickened mouth 56 and force the valve housing 22 upwardly so as to compress and seal the valve gasket 30 against the inwardly facing surface of the ferrule 8 in a conventional manner. A ferrule gasket 65 is accommodated within the ferrule 8 and the ferrule gasket 65 has a central aperture formed therein which receives the valve housing 22 therein. The ferrule gasket 65 facilitates forming a fluid tight seal between the ferrule 8 and the base container 4 when the ferrule 8 is secured to the base container 4 to form the pressurizable container 2 (see FIG. 1). If a mounting cup is utilized instead of the ferrule, the mounting cup generally has a polypropylene layer provided on an inwardly facing surface thereof for engaging with and forming a fluid tight seal with the opening of the base container 4, when the mounting cup is crimped thereto, to form the pressurizable container 2, and thus the additional ferrule gasket is generally not required.

The valve stem 26 includes an annular flange 66 which is formed integral therewith in an intermediate section of the valve stem 26. If desired, an annular recess (not number) may be formed in an undersurface of the annular flange 66 to provide a space or area to allow displacement of the compressible sealing member 68, during compression thereof, thereby reducing the force required to depress the valve to the open position (see FIGS. 2, 3, 4 and 4B, for example). The recess (not number) formed in an undersurface of the annular flange 66 has a rectangular shaped cross section and the top surface of the compressible sealing member 68 has a complimentary shaped protrusion, e.g., a complimentary protrusion with a rectangularly shaped cross section, which is intimately received within the annular recess (not number).

Figure 3A:
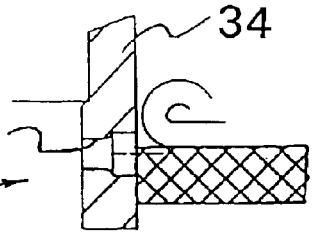
FIG. 3A is an enlarged diagrammatic view of area B of FIG. 3.

An annular rib 66' (see FIG. 2A) is formed on an top surface of the annular flange 66 to facilitate forming a fluid tight seal with an undersurface of the valve gasket 30. A downwardly facing surface of the annular flange 66 is provided with a compressible sealing member 68 while an upwardly facing and mating surface of the base wall 62 supports an integral annular sealing edge 70. The compressible sealing member 68 may be adhesively secured to or otherwise permanently affixed to the downwardly facing surface of the annular flange 66 to ensure a permanent attachment thereto. Alternatively, the compressible sealing member 68 may be secured to the downwardly facing surface of the annular flange 66 by a fictional connection with a lower portion of the valve stem 26 integrally molded therewith (see FIG. 9). A leading surface of the compressible sealing member 68 and a leading edge of the annular sealing edge 70 are normally spaced apart from one another by a small distance, e.g., about 0.020 of an inch to about 0.040 of an inch so that when the valve stem 26 is at least partially depressed, the compressible sealing member 68 engages with the annular sealing edge 70 to commence formation of a fluid tight seal between those two components. The spring 28 is compressibly disposed between the base wall 62 and the annular flange 66 to urge the valve stem 26 away from the base wall 62 into its elevated normally closed position. Upon initially engagement between the compressible sealing member 68 and the annular sealing edge 70 (see FIG. 3), the at least one radial passageway(s) 50 is still normally closed off by abutting engagement between the annular side wall of the valve portion 34 of the valve stem 26 and the inwardly facing surface of the valve gasket 30 (see FIG. 3A). The compressible sealing member 68 generally must be compressed at least about 0.005 of an inch, more preferably the compressible sealing member must be compressed at least about 0.010 of an inch, and most preferably the compressible sealing member must be compressed at least about 0.020 of an inch, before the at least one radial passageway(s) 50 is brought into fluid communication with the metering chamber 58 to commence dispense product therefrom through the stem portion 34.

The housing inlet 64, formed in the base wall of the valve housing 22, is coupled to a leading end of a product dip tube 74. A remote end of the product dip tube 74 is positioned so as to communicate with a base 76 of the pressurizable container 2 to facilitate dispensing of the product to be dispensed therefrom. The housing inlet 64 is sized to receive the leading end of the dip tube 74 and at least the leading end has an interference fit with the housing inlet 64 to ensure a secure and permanent connection between those two components. The housing inlet 64 may have an annular protrusion (not numbered) to assist with permanent retention of the leading end of the dip tube 74 within the housing inlet 64.

The annular sealing edge 70 and the compressible sealing member 68 together, due to depression of the valve stem 26, facilitate dividing, separating or partitioning the internal cavity 24 of the valve housing 22 into two separate chambers, namely, a centrally located filling chamber 78 and a radially outwardly located metering chamber 58. Due to this arrangement, when the valve stem 26 is sufficiently depressed in the direction of arrow D, the valve stem 26 partially compresses the spring 28 and moves the annular flange 66 and the compressible sealing member 68, supported by the undersurface thereof, into an abutting engagement with the annular sealing edge 70 (see FIG. 3). Once the compressible sealing member 68 and the annular sealing edge 70 sufficiently engaged with one another, such engagement partitions the internal cavity 24 into the filling chamber 78 and the radially outwardly located metering chamber 58. Such engagement prevents the further flow of product to be dispensed from the filling chamber 78 into the metering chamber 58. It is to be appreciated that the valve gasket 30 is still maintained in sealing engagement with the exterior surface of the valve portion 34 of the valve stem 26 (see FIG. 3A) so that the dispensing of product through the at least one radial passageway(s) 50 and the central passageway 42 is not permitted.

Figures 4, 4A:
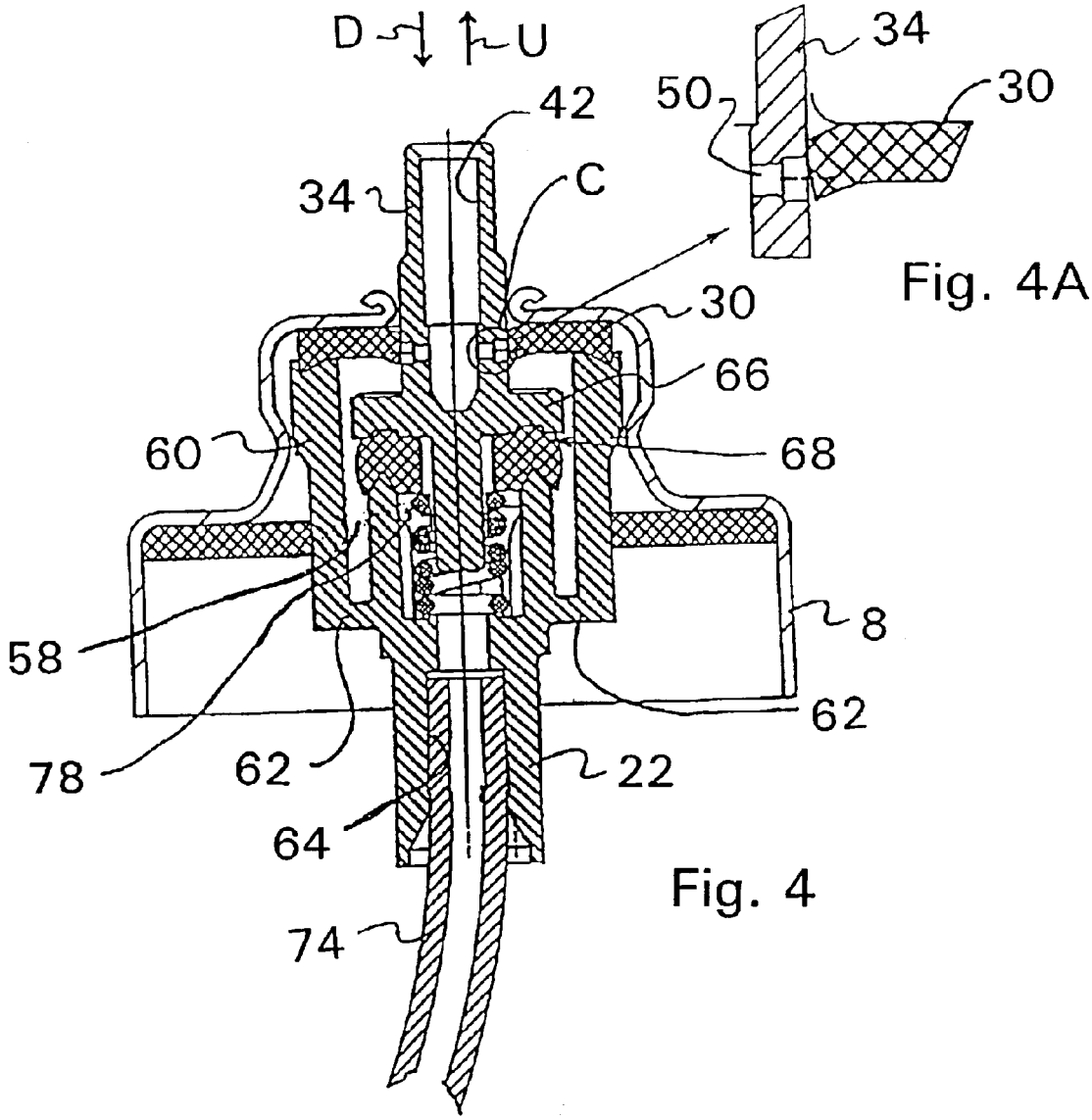
FIG. 4 is a diagrammatic cross-sectional view, of the metering valve assembly of FIG. 2, showing the fully depressed position of the aerosol valve so that the product contents, from the metering chamber, are discharged out through the stem.
FIG. 4A is an enlarged diagrammatic view of area C of FIG. 4.
Figure 4B:
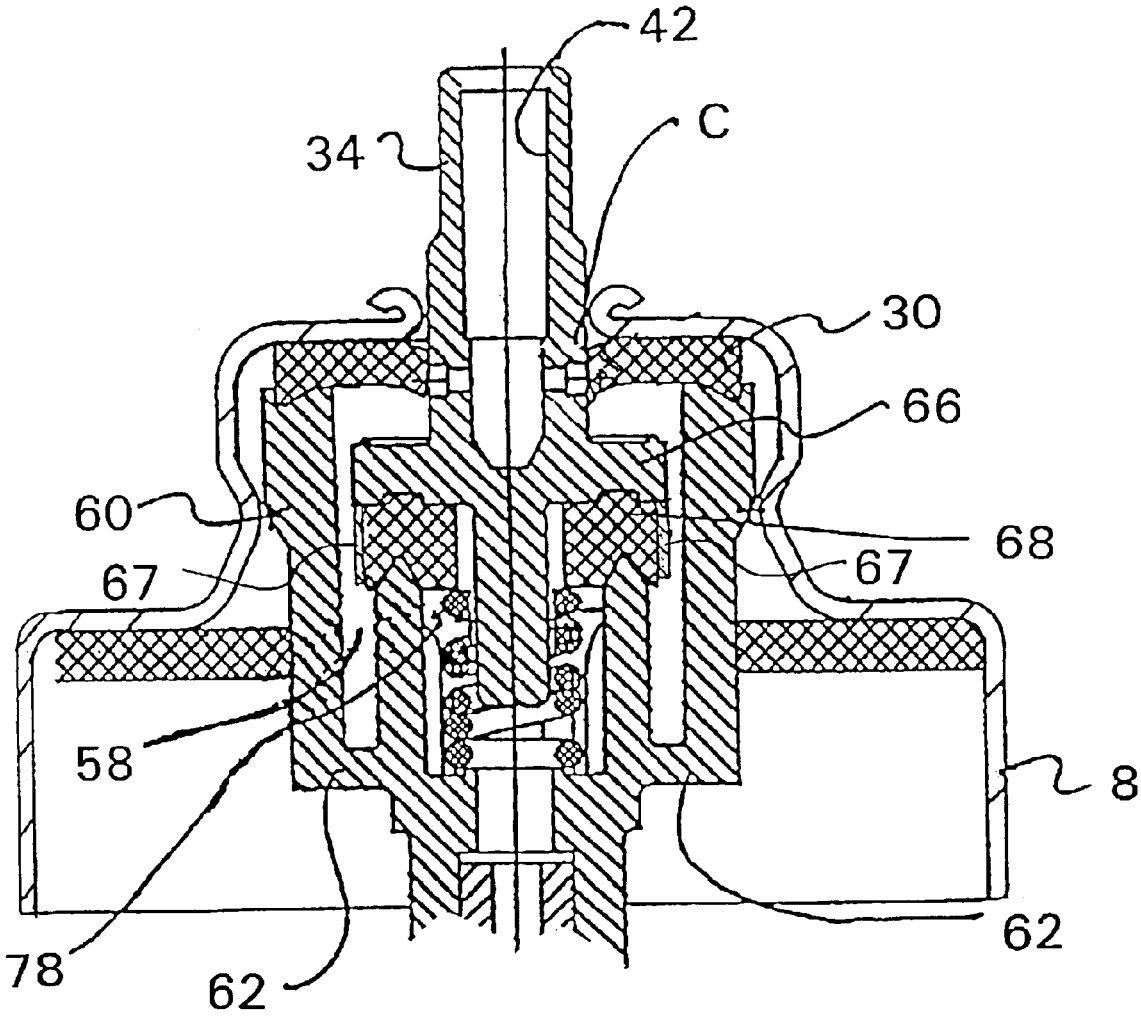
FIG. 4B is a diagrammatic cross-sectional view of the valve stem showing an alternative embodiment for limiting radial reconfiguration, expansion and/or movement of the compressible sealing member during compression thereof.

Upon further depression of the valve stem 26 in the direction of arrow D, the degree of engagement between the compressible sealing member 68 and the annular sealing edge 70 increases and the at least one radial passageway(s) 50 eventually ceases to be sealed by the valve gasket 30 so that the at least one radial passageway(s) 50 is brought into fluid communication with the metering chamber 58 (see FIG. 4A). Once this occurs, substantially all of the product, contained within the metering chamber 58, is permitted to flow radially inwardly, through the at least one radial passageway(s) 50, and axially along the central passageway 42 of the valve stem 26 to the actuator 38 and be dispensed by the actuator 38 into the surrounding environment. Due to the engagement between the compressible sealing member 68 and the annular sealing edge 70, only a portion of the product contained within the metering chamber 58, e.g., about 30 to 300 microliters, is permitted to be dispensed by the metering valve assembly 10 regardless how long or to what degree or extent the valve stem 26 is depressed by an operator. Once the pressure within the metering chamber 58 becomes essentially atmospheric, no further product is able to be dispensed from the metering chamber 58.

Once the applied depression force is removed from the valve stem 26, the valve stem 26 is biased, due to the action of the compression spring 28, in the direction of arrow U into its closed position. As this occurs, the fluid communication between the metering chamber 58 and the at least one radial passageway(s) 50 is first interrupted. After this occurs, further movement of the valve stem 26, in a direction of arrow U, re-establishes communication between the filling chamber 78 and the metering chamber 58 so that the product to be dispensed is again allowed to flow through the dip tube 74 into the internal cavity 24 of the valve housing 22 and replenish the dispensed supply of product contained within the metering chamber 58. Such replenishing of the metering chamber 58 facilitates dispensing of further product to be dispensed each time the valve stem 26 is sufficiently depressed by an operator. Due to the bias of the spring 28, the valve stem 26 is normally in its closed position and further product can not be dispensed from the metering valve assembly 10 until the valve stem 26 is again sufficiently depressed, in the direction of arrow D, to first initially partition, divide or separate the filling chamber 78 from the metering chamber 58 and, thereafter, establish a product flow path from the metering chamber 58 to the actuator 38 via the at least one radial passageway(s) 50 and the central passageway 42.

The annular flange 66 may be provided, if desired, with a downwardly directed or extending shroud, cage, sleeve, a plurality of spaced apart legs or some other component 67 (see FIG. 4B) which ensures that the compressible sealing member 68, during compression thereof by the valve stem 26, is prevented from reconfiguring itself, expanding radially or moving radially against the inwardly facing surface of the side wall of the valve housing 22. If such radial reconfiguration, expansion and/or movement of the sealing member 68 were to occur, it is possible that the compressible sealing member 68 could also partition or divide the metering chamber 58 into upper and lower regions whereby only the product located in the upper region of the metering chamber 58, but not the product located in the lower region of the metering chamber 58, could be dispensed from the metering chamber 58 upon complete depression of the valve stem 26. This result would be undesirable as less than the desired metered amount of product would be dispensed by the metering valve and this possibility should be avoided. The shroud, the cage, the sleeve, the plurality of spaced apart legs or other component 67 is supported by the lower surface of the annular flange 66 in such a manner to act as a barrier and either completely prevent or limit the amount of radial reconfiguration, expansion and/or movement of the compressible sealing member 68 which can occur during compression thereof by the valve stem 26. Preferably the shroud, the cage, the sleeve, the plurality of spaced apart legs or other component 67 extend downwardly from the annular flange 66 by a distance of between about 0.045 of an inch and about 0.070 of an inch or so.

Figure 4C:
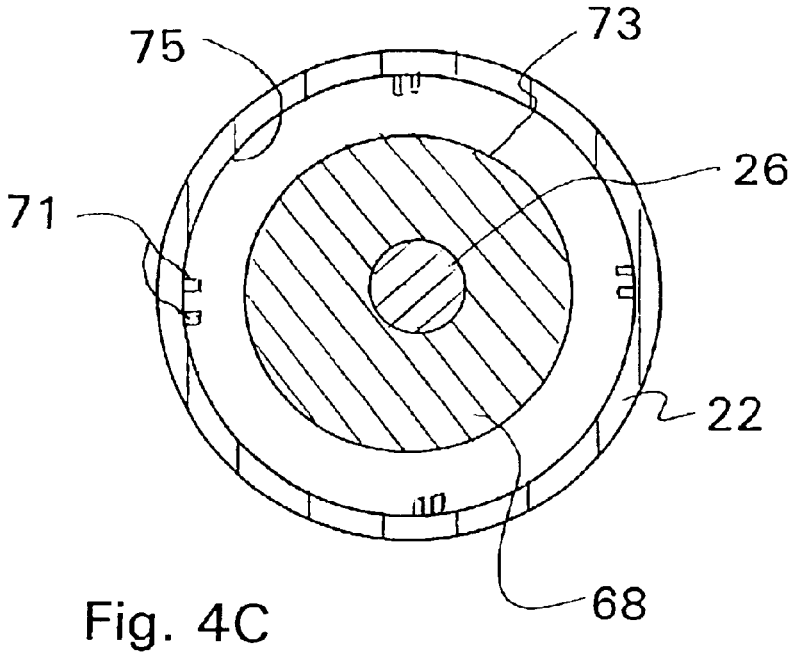
FIG. 4C is a top diagrammatic cross-sectional view of the valve housing showing a further alternative embodiment for limiting radial reconfiguration, expansion and/or movement of the compressible sealing member during compression thereof.

With reference to FIG. 4C, a second embodiment for preventing the compressible sealing member from partition or dividing the metering chamber 58 into upper and lower regions is shown and will now be described. As shown in this embodiment, a shroud, cage, sleeve, a plurality of spaced apart legs or some other component is not utilized. Rather, an inwardly facing surface, located adjacent the compressible sealing member 68, is provided with at least one pair of closely spaced ribs or some other protrusion members 71 which are located to engage with a side surface 73 of the compressible sealing member 68, during compression thereof by the valve stem 26, to prevent the compressible sealing member 68 from reconfiguring itself, expanding radially or moving radially against and completely sealing with the inwardly facing surface of the side wall 75 of the valve housing 22. The at least one pair of closely spaced ribs or some other protrusion members 71 generally abut with the side surface 73 of the compressible sealing member 68 and prevent that side surface 73 from forming a fluid tight seal with the inwardly facing side wall 75 of the valve housing 22 and thereby partition or dividing the metering chamber 58 into upper and lower regions whereby only the product located in the upper region of the metering chamber 58, but not the product located in the lower region of the metering chamber 58, can be dispensed from the metering chamber 58 upon complete depression of the valve stem 26. That is, the at least one pair of closely spaced ribs or some other protrusion members 71 form a passageway therebetween which facilitates continuous communication between the upper and the lower regions. Preferably, there are a plurality of equally spaced pairs of closely spaced ribs or some other protrusion members 71 provided on the inwardly facing surface of the valve housing 22, e.g., three or four pairs of closely spaced ribs or protrusion members, and each rib or protrusion member 71 extends radially inward from the side wall by a distance of between about 0.005 and about 0.025 of an inch or so.

Figure 4D:
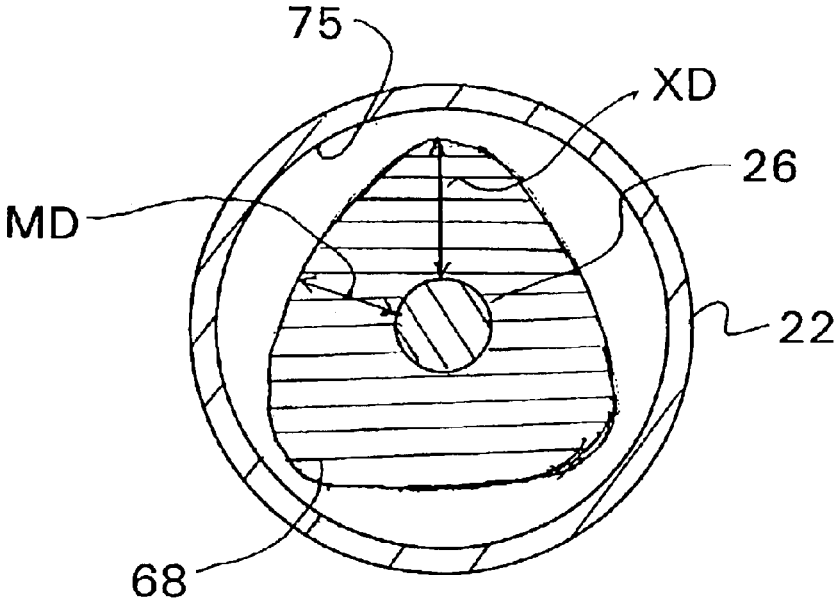
FIG. 4D is a diagrammatic top view of the compressible sealing member showing another alternative embodiment for limiting radial reconfiguration, expansion and/or movement of the compressible sealing member during compression thereof.

Turning now to FIG. 4D, a further embodiment for preventing the compressible sealing member from partition or dividing the metering chamber 58 into upper and lower regions is shown and will now be described. According to this embodiment, the perimeter profile or shape of the compressible sealing member 68 is altered to prevent it from partitioning or dividing the metering chamber 58 into upper and lower regions. That is, the exterior shape or profile of the compressible sealing member is non circular or non-cylindrical, e.g., somewhat triangular in shape as can be seen in FIG. 4D, such that the compressible sealing member 68 has both a maximum dimension XD and a minimum dimension MD. Due to this arrangement of the compressible sealing member 68, as the compressible sealing member 68 is compressed by the valve stem 26, only certain areas or regions of the compressible sealing member 68 may possibly be able to abut with the inwardly facing side wall of the valve housing 22, i.e., the maximum dimension areas, while other remaining areas or regions, i.e., the minimum dimension areas, can not sufficiently radial reconfigure, expand and/or move so as to abut with and seal against the inwardly facing side wall 75 of the valve housing 22. Accordingly, the compressible sealing member 68 is thus prevented from forming a fluid tight seal with the inwardly facing side wall 75 of the valve housing 22 and partition or divide the metering chamber 58 into upper and lower regions whereby only the product located in the upper region of the metering chamber 58, but not the product located in the lower region of the metering chamber 58, could be dispensed from the metering chamber 58 upon complete depression of the valve stem 26. The gasket maximum dimension XD preferably is between about 0.215 and about 0.225 of an inch or so while the gasket minimum dimension MD preferably is between about 0.200 and about 0.210 of an inch or so. The difference between the gasket maximum dimension XD and the gasket minimum dimension MD preferably is between about 0.015 and about 0.025 of an inch or so.

Figures 5, 6, 7:
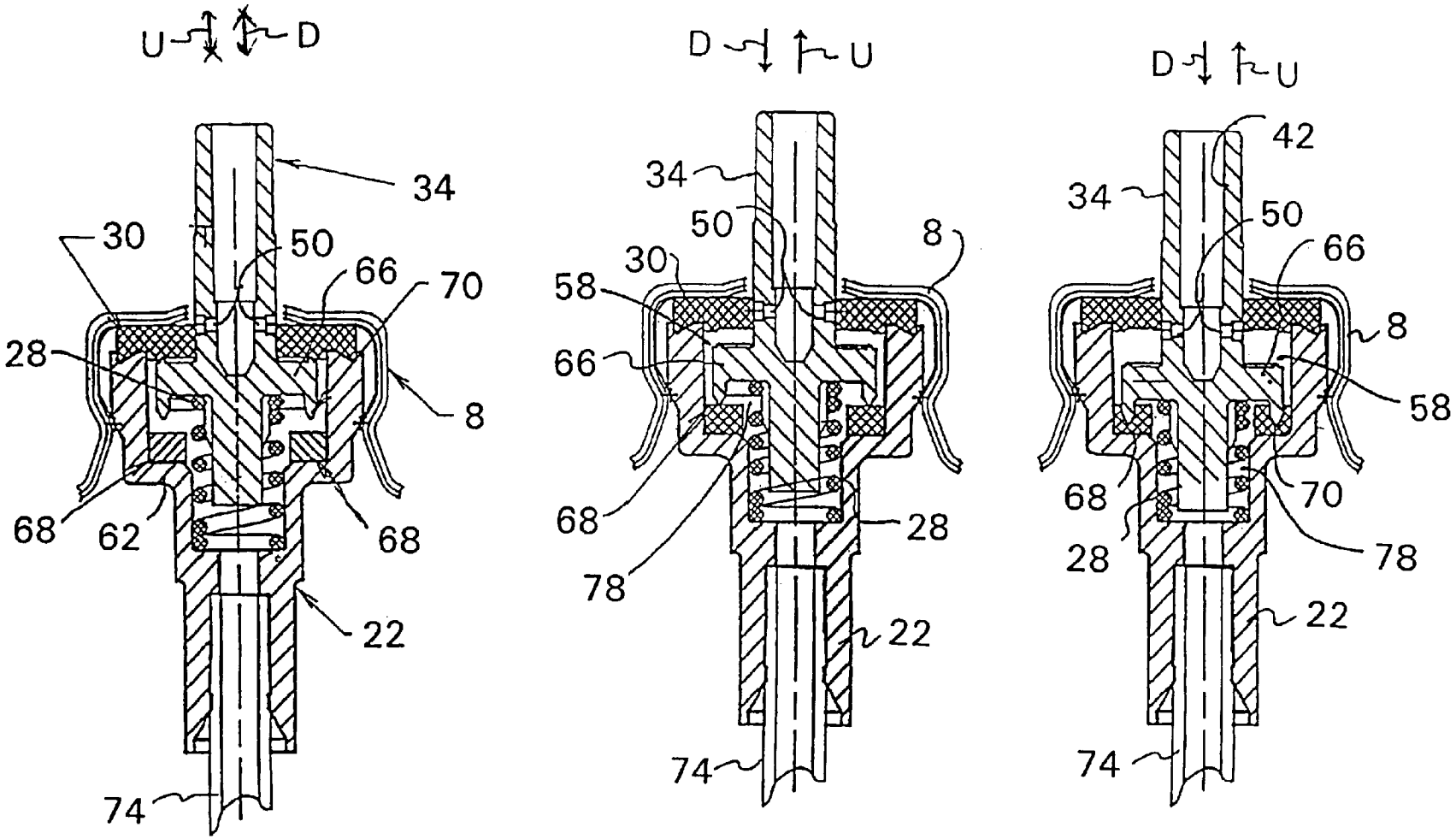
FIG. 5 is a diagrammatic cross-sectional view of a second embodiment of the metering valve assembly, according to the present invention, shown in a normally biased closed position.
FIG. 6 is a diagrammatic cross-sectional view, of the metering valve assembly of FIG. 5, showing the metering valve assembly in a partially depressed position where the valve stem seals with the annular sealing edge of the valve housing.
FIG. 7 is a diagrammatic cross-sectional view, of the metering valve assembly of FIG. 5, showing the fully depressed position of the metering valve assembly so that the product contents, from the metering chamber, are discharged out through the stem.

With reference now to FIGS. 5–7, a brief description concerning a second embodiment of the metering valve assembly 10 will now be provided. As this embodiment is very similar to the first embodiment, a detailed description concerning only the differences between the first and second embodiments will be provided.

The major difference between the first embodiment and the second embodiment is the location of the compressible sealing member 68 and the annular sealing edge 70. According to this embodiment, the downwardly facing surface of the annular flange 66 is provided with an integral annular sealing edge 70 while an upwardly facing and mating surface of the base wall 62 is provided with the compressible sealing member 68. The compressible sealing member 68 may be adhesively secured to or otherwise permanently affixed to the base wall 62 of the valve housing 22 to ensure a permanent attachment thereto. Alternatively, the compressible sealing member 68 may merely be secured to the downwardly facing surface of the annular flange 66 by a slight interference fit with the interior cavity 24 of the valve housing 22. The compressible sealing member 68 and the annular sealing edge 70 are normally spaced apart from one another by a small distance, e.g., about 0.020 of an inch to about 0.040 of an inch so that when the valve stem 26 is at least partially depressed, the compressible sealing member 68 engages with the annular sealing edge 70 to form a fluid tight seal between those two components. The spring 28 urges the valve stem 26, away from the base wall 62, into its elevated normally closed position. As with the first embodiment, upon initial engagement between the compressible sealing member 68 and the annular sealing edge 70, the at least one radial passageway(s) 50 is still normally closed by abutting engagement between the valve portion 34 of the valve stem 26 and the valve gasket 30.

The annular sealing edge 70 and the compressible sealing member 68 together facilitate dividing, separating or partitioning the internal cavity 24 of the valve housing 22 into the centrally located filling chamber 78 and the radially outwardly located metering chamber 58. Accordingly, as with the first embodiment, when the valve stem 26 is sufficiently depressed in the direction of arrow D, the valve stem 26 partially compresses the spring 28 and moves the annular flange 66 and the annular sealing edge 70, supported by the undersurface thereof, into an abutting engagement with the compressible sealing member 68. Once the compressible sealing member 68 and the annular sealing edge 70 sufficiently engaged with one another, such engagement partitions the internal cavity 24 into the filling chamber 78 and the radially outwardly located metering chamber 58. Such engagement prevents the further flow of product to be dispensed from the filling chamber 78 to the metering chamber 58. It is to be appreciated that the valve gasket 30 is still maintained in sealing engagement with the exterior surface of the valve portion 34 of the valve stem 26 (see FIG. 6) so that the dispensing of product through the at least one radial passageway(s) 50 and the central passageway 42 is not permitted.

Upon further depression of the valve stem 26 in the direction of arrow D, the degree of engagement between the compressible sealing member 68 and the annular sealing edge 70 increases and the at least one radial passageway(s) 50 eventually ceases to be sealed by the valve gasket 30 so that the at least one radial passageway(s) 50 is brought into fluid communication with the metering chamber 58 (see FIG. 7). Once this occurs, a portion of the product, contained within the metering chamber 58, is permitted to flow radially inwardly, through the at least one radial passageway(s) 50, and axially along the central passageway 42 of the valve stem 26 to the actuator 38 and be dispensed by the actuator 38 into the surrounding environment. Due to the engagement between the compressible sealing member 68 and the annular sealing edge 70, only a portion of the product contained within the metering chamber 58, e.g., about 30 to 300 microliters, is permitted to be dispense by the metering valve assembly 10 regardless how long or to what degree or extent the valve stem 26 is depressed by an operator. Once the pressure within the metering chamber 58 becomes essentially atmospheric, no further product is able to be dispensed from the metering chamber 58.

When the applied depression force is removed from the valve stem 26, the valve stem 26 is biased, due to the action of the compression spring 28, in the direction of arrow U into its closed position. As this occurs, the fluid communication between the metering chamber 58 and the at least one radial passageway(s) 50 is first interrupted. After this occurs, further movement of the valve stem 26, in a direction of arrow U, re-establishes communication between the filling chamber 78 and the metering chamber 58 so that the product to be dispensed is again allowed to flow through the dip tube 74 into the internal cavity 24 of the valve housing 22 and replenish the supply of product contained within the metering chamber 58. Such replenishing of within the metering chamber 58 facilitates dispensing of further product to be dispensed each time the valve stem 26 is sufficiently depressed by an operator. Due to the bias of the spring 28, the valve stem 26 is normally in its closed position and further product can not be dispensed from the metering valve assembly 10 until the valve stem 26 is again sufficiently depressed, in the direction of arrow D, to first initially partition, divide or separate the filling chamber 78 from the metering chamber 58 and, thereafter, establish a product flow path from the metering chamber 58 to the actuator 38 via the at least one radial passageway(s) 50 and the central passageway 42.

Figure 8A:
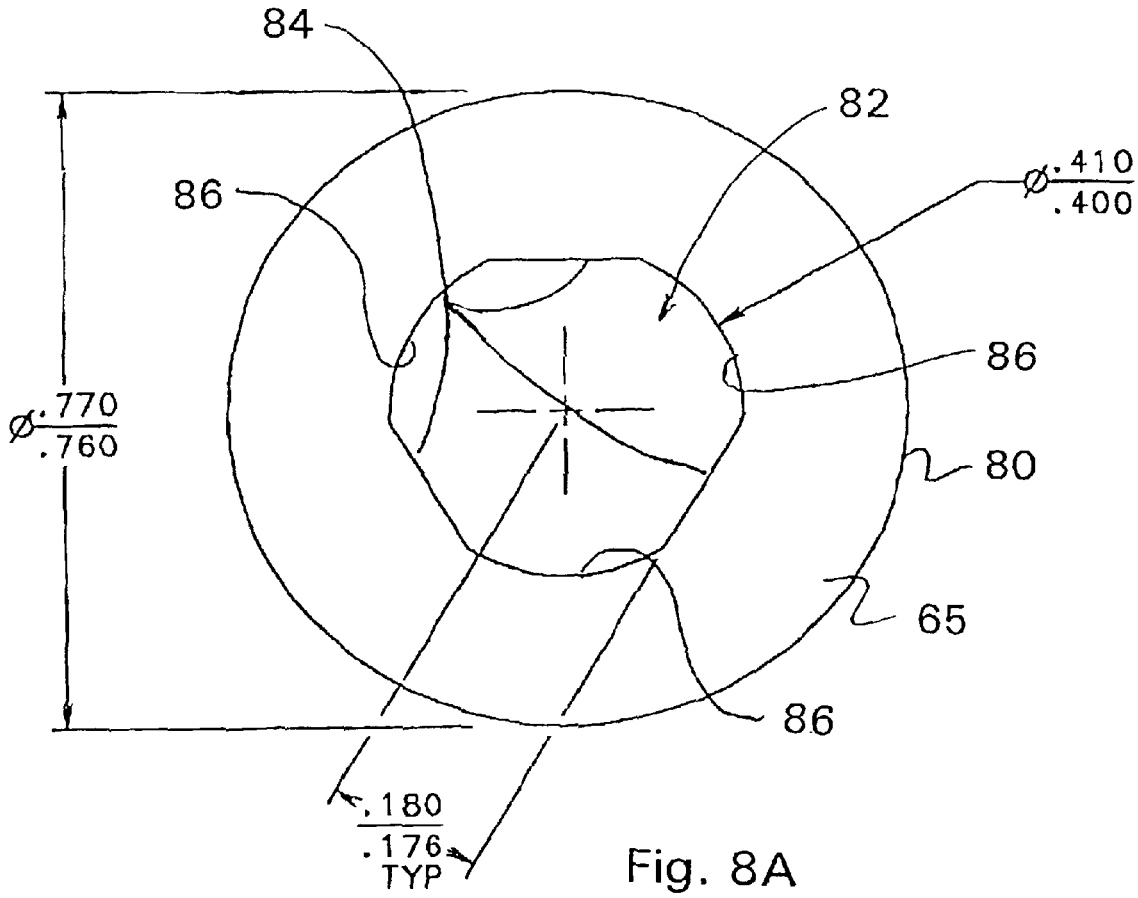
FIG. 8A is a diagrammatic top plan view of the improved ferrule gasket according to the present invention.
Figure 8B:
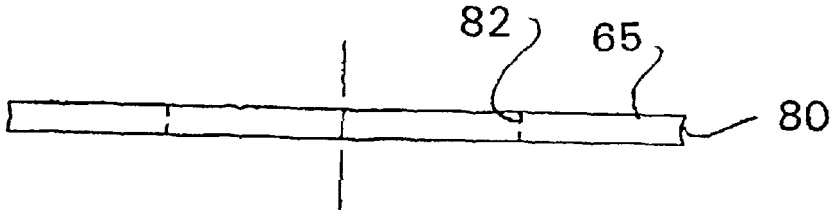
FIG. 8B is a diagrammatic front elevational view of FIG. 8A.
Figure 8C:
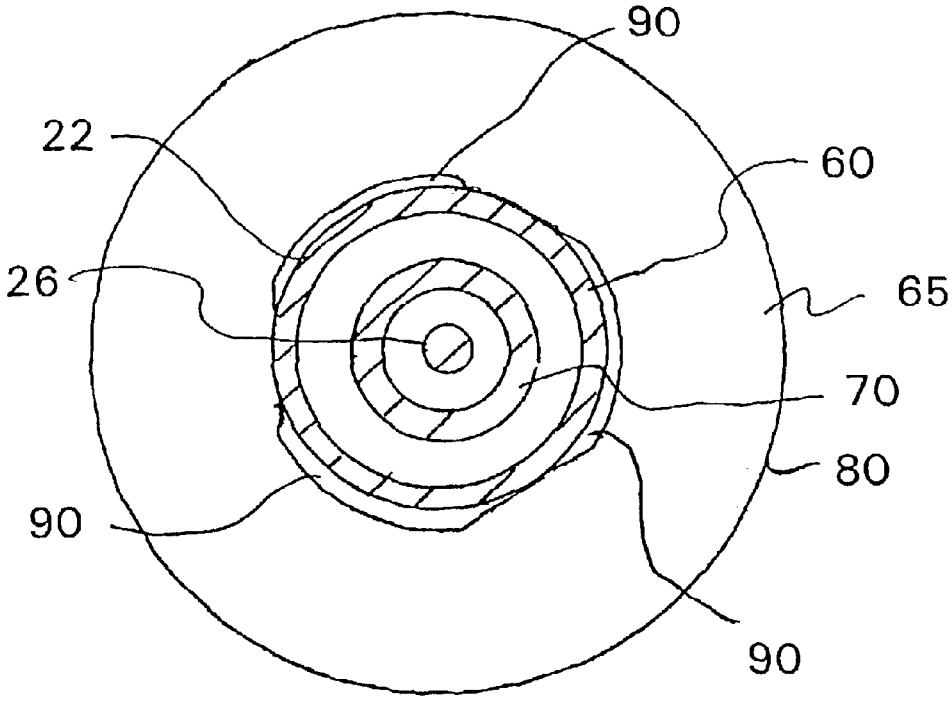
FIG. 8C is a diagrammatic cross-sectional view through a valve housing, incorporating the ferrule gasket of FIG. 8A, showing three passageways which are established between the improved ferrule gasket and the valve housing.

With reference now to FIGS. 8A, 8B and 8C, a detailed description concerning the improved ferrule gasket 65, according to the present invention, will now be described. As can be seen in these Figures, the ferrule gasket 65 has a substantially cylindrical, exterior surface 80 which typically has a diameter slightly smaller than the interior diameter of the ferrule 8 to which the ferrule gasket 65 is to be applied, i.e., the diameter of the ferrule gasket 65 is between 0.5 to 1 inch, typically about 0.770 to about 0.760 or so. In addition, the ferrule gasket typically has a thickness of between 0.01 to about 0.7 of an inch, typically about 0.035 of an inch.

A novel feature of the ferrule gasket 65, according to the present invention, relates to the shape of the through hole 82 which passes through the ferrule gasket 65. Rather than there being a traditional cylindrical through hole, the through hole 82 of the ferrule gasket 65 according to the present invention is a complex shape. That is, a portion of the through hole 82 through the ferrule gasket 65 generally comprises three generally flat surfaces or sides of an equilateral triangle 84 while the apexes of each mating surfaces or sides of the equilateral triangle is an acuate section 86, as can be seen in FIGS. 8A and 8C. A smooth transition 88 is formed between each end of the sides of an equilateral triangle and each acuate section 86. As a result of this through hole arrangement, the through hole 82 in the ferrule gasket 65 has three generally flat surfaces which, when the ferrule gasket 65 engages with the valve housing 22, are somewhat compressed and conform to the exterior surface of the valve housing 22 to securely fasten the ferrule gasket 65 thereto. However, the three acuate sections 86 of the through hole still remain spaced from the valve housing 22 to form three spaced apart product flow passageways 90 between the ferrule gasket 65 and the exterior surface of the valve housing 22. These three product flow passageways 90 facilitate the charging of the pressurizable cannister or container 2 with a desired propellent and product to be dispensed during a conventional filling or charging process which is well known in the art. That is, during a conventional filling or charging process, e.g., a typical button off filling process, as the product flows along the exterior surface of the valve stem 26 between the top surface of the gasket 30 and the downwardly facing surface of the ferrule 8, toward the interior cavity 6 of the base container 4. The product eventually flows downwardly and must pass by the ferrule gasket 65. As this product flows downwardly and reaches the top surface of the ferrule gasket 65, the product is channeled through the three equally spaced passageways 90, formed between the ferrule gasket 65 and the valve housing 22, which allow the product to be relatively easily conveyed to the interior cavity 6 of the base container 4.

It is to be appreciated that the three flat surfaces 84 of the ferrule gasket 65 provide a sufficiently tight engagement with the exterior surface of the valve housing 22 to essentially permanently attach the ferrule gasket 65 and thus facilitate manipulation and transportation of the valve assembly 10 without the ferrule gasket 65 becoming dislodged or separated from the remainder of the metering valve assembly 10. The secure attachment of the ferrule gasket 65 to the metering valve assembly 10 reduces the inspection of the metering valve assembly 10 during manufacture of the pressurizable container 2.

The metering chamber is designed to hold a volume of between 30 and 300 microliters of the product to be dispensed, more preferably the metering chamber is designed to hold a volume of between 40 and 100 microliters of the product to be dispensed metering chamber and preferably the metering chamber is designed to hold about 50 microliters of the product to be dispensed. The annular sealing edge 70 preferably has a diameter of between about 0.18 of an inch and about 0.25 of an inch and has a height of between about 1/32 of an inch and about 1/16 of an inch. The compressible sealing member 68 preferably has a diameter of between about 0.20 of an inch and about 0.30 of an inch and has a thickness of between about 0.045 of an inch and about 0.070 of an inch. The compressible sealing member is preferably manufactured from rubber, some other elastomeric material or from some other suitable gasket or seal material. Such arrangement ensures a sufficient sealing between the compressible sealing member 68 and the annular sealing edge 70 when the valve stem 26 is sufficiently depressed.

In order to fill the pressurizable container 2 with a desired propellant and product, a charging head (not shown) is connected to a source product and/or propellant (not shown) under relatively high pressure, e.g., 900 psig, and the charging head is designed to surround and sealingly engage with the top surface of the mounting cup or ferrule 8 to facilitate charging of the pressurized component(s). During the filing process, e.g., typically a button-off-filling process, the charging head is first lowered into a sealingly engagement with the pressurizable container 2 to prevent the inadvertent escape of propellant and/or product during the charging process. A product charging path is established by the charging head along an exterior surface of the valve stem 26 and the aperture 36 in the ferrule 8 and then between a top surface of the gasket 30, as it is at least partially spaced from an inwardly facing surface of the ferrule 8, e.g. a few thousandths of an inch or so, to form a propellent and/or product flow path therebetween. The propellant and/or product continues to flow radially along the inwardly facing surface of the ferrule 8, between the ferrule 8 and the gasket 30, and then axially down along the inwardly facing surface of the ferrule 8, between the ferrule 8 and the exterior surface of the valve housing 22, until the propellent and/or product reaches the product/propellent internal cavity 6 of the pressurized container 2. Upon completion of the charging process, the charging head is withdrawn.

Figure 9:
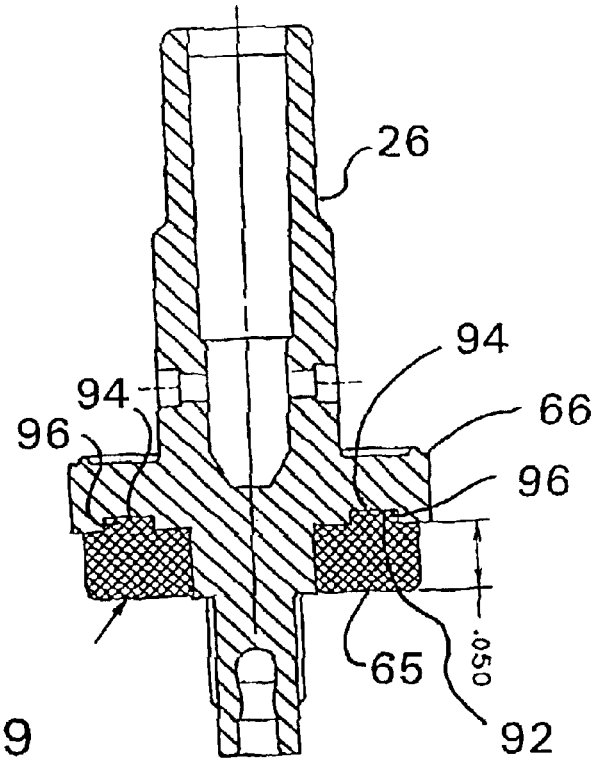
FIG. 9 is a diagrammatic cross-sectional view showing a variation of the metering valve assembly of FIG. 2.

With reference to FIG. 9, a modification to the embodiment of FIG. 2 will now be discussed. As this embodiment is very similar to the first embodiment, a detailed description concerning only the differences between this embodiment and the first embodiment will be provided.

The downwardly facing surface of the annular flange 66 is provided with a an annular recess 92 which tapers from an entry toward a base 94 thereof, i.e., the annular recess is slightly narrower at its entry and has an increasing taper to a slightly wider base 94. The mating facing surface of the compressible sealing member 68, on the other hand, is provided with a complimentary shaped head 96, i.e., the complimentary shaped head 96 is slightly narrower at its trunk and tapers to a slightly wider free end thereof. Due to this arrangement, the complimentary shaped head 96 of the compressible sealing member 68 is captively received by the annular recess 92 to fixedly retain the compressible sealing member 68 to the lower surface of the annular flange 66 to permanently retain the compressible sealing member 68 attached to the annular flange 66. In this embodiment, preferably the compressible sealing member 68 has a thickness of about 0.05 inches and is manufactured from an elastomer material.

The embodiment of FIG. 9 is preferably manufactured during a two step molding process in which the annular flange 66, having the annular recess 92 which tapers from an entry toward a base thereof, is first formed in a mold. Thereafter, during a second step of the molding process, the desired elastomer material, e.g., such as olefin based thermo elastomer or some other equivalent material for example, is injected into the mold and this elastomer material flows into the annular recess 92 of the annular flange 66 and is shaped by the mold to form the compressible sealing member 68. The combined annular flange/compressible sealing member assembly is then allowed to solidify sufficiently in a conventional manner and then ejected from the mold. Following manufacture of combined annular flange/compressible sealing member assembly, the compressible sealing member 68 is permanently secured to the lower surface of the annular flange 66 and this permanent securement simplifies the manufacture of an aerosol valve as the compressible sealing member 68 can not become separated or dislodged from the annular flange 66 during the assembly process of the aerosol valve.

Figure 10:
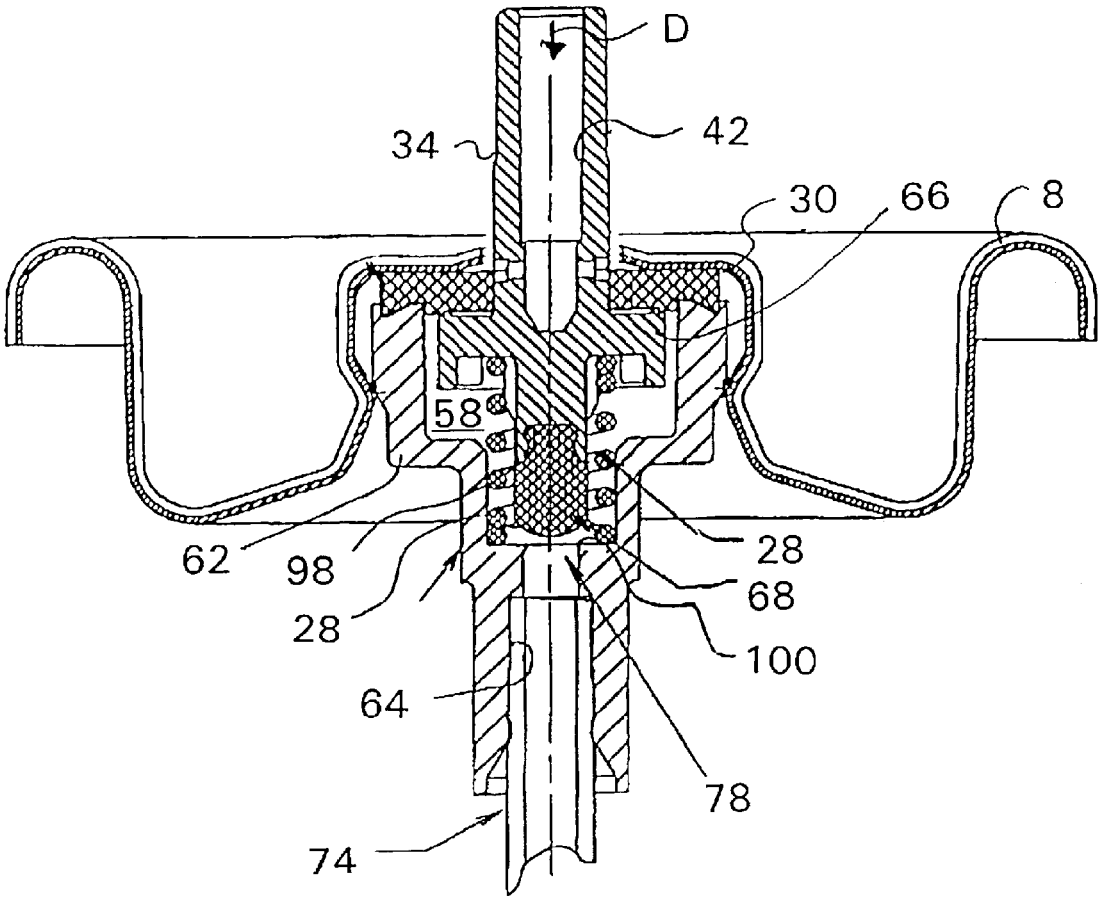
FIG. 10 is a diagrammatic cross-sectional view of a fourth embodiment of the metering valve assembly, according to the present invention, shown in a normally biased closed position.

A fourth embodiment of the present invention will now be discussed with reference to FIG. 10. As this embodiment is very similar to the previous embodiments, a detailed description concerning only the differences between this embodiment and the prior embodiments will be provided.

As with the prior embodiments, the valve stem 26 includes an annular flange 66 which is formed integral therewith in an intermediate region of the valve stem 26. Rather than a downwardly facing surface of the annular flange 66 being provided with either a compressible sealing member 68 or sealing edge 70, the lower most end portion of the annular flange 66 has a cavity 98 or other recess which accommodates and supports a compressible sealing member 68. The compressible sealing member 68 may be adhesively secured to or otherwise permanently affixed to the cavity 98 or lower most end portion of the annular flange 66 to ensure a permanent attachment thereto or, alternatively, the compressible sealing member 68 may be secured with the valve stem 26 by a fictional connection, a two step molding process, or some or conventional connection. An exterior surface of the compressible sealing member 68 and the annular sealing seat 100 of the valve housing are normally spaced apart from one another by a small distance, e.g., about 0.020 of an inch to about 0.040 of an inch, so that when the valve stem 26 is at least partially depressed, a leading face of the compressible sealing member 68 engages with the annular sealing seat 100 to form a fluid tight seal between those two components and prevent the flow of fluid thereby.

The annular sealing seat 100 and the compressible sealing member 68 together facilitate dividing, separating or partitioning the internal cavity 24 of the valve housing 22 into two chambers, namely, a metering chamber 58 located within the valve assembly, and the housing inlet 64 which forms a filling chamber 78. Due to this arrangement, when the valve stem 26 is sufficiently depressed in the direction of arrow D, the valve stem 26 partially compresses the spring 28 and moves the annular flange 66 and the compressible sealing member 68, supported at a leading end thereof, into an abutting engagement with the annular sealing seat 100. Once the compressible sealing member 68 and the annular sealing seat 100 sufficiently engage with one another, such engagement partitions the internal cavity 24 into the metering chamber 58 and a remainder of the pressurized container 2. Such engagement prevents the further flow of product to be dispensed from the remainder of the pressurized container 2 into the metering chamber 58. It is to be appreciated that the valve gasket 30 is initially still maintained in sealing engagement with the exterior surface of the valve portion 34 of the valve stem 26 so that the dispensing of product through the at least one radial passageway(s) 50 and the central passageway 42 is not permitted until the valve stem 26 is sufficiently depressed.

Figure 10A:
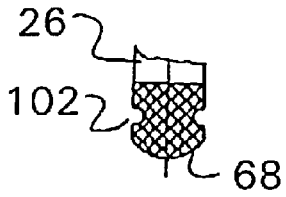
FIG. 10A shows an alternative design for the compressible sealing member which has an annular indentation to facilitate compression thereof.

FIG. 10A shows an alternative design for the compressible sealing member 68 in which an annular indentation 102 in the compressible sealing member 68 facilitates compression thereof when the compressible sealing member 68 engages with the annular sealing seat.

Figure 11:
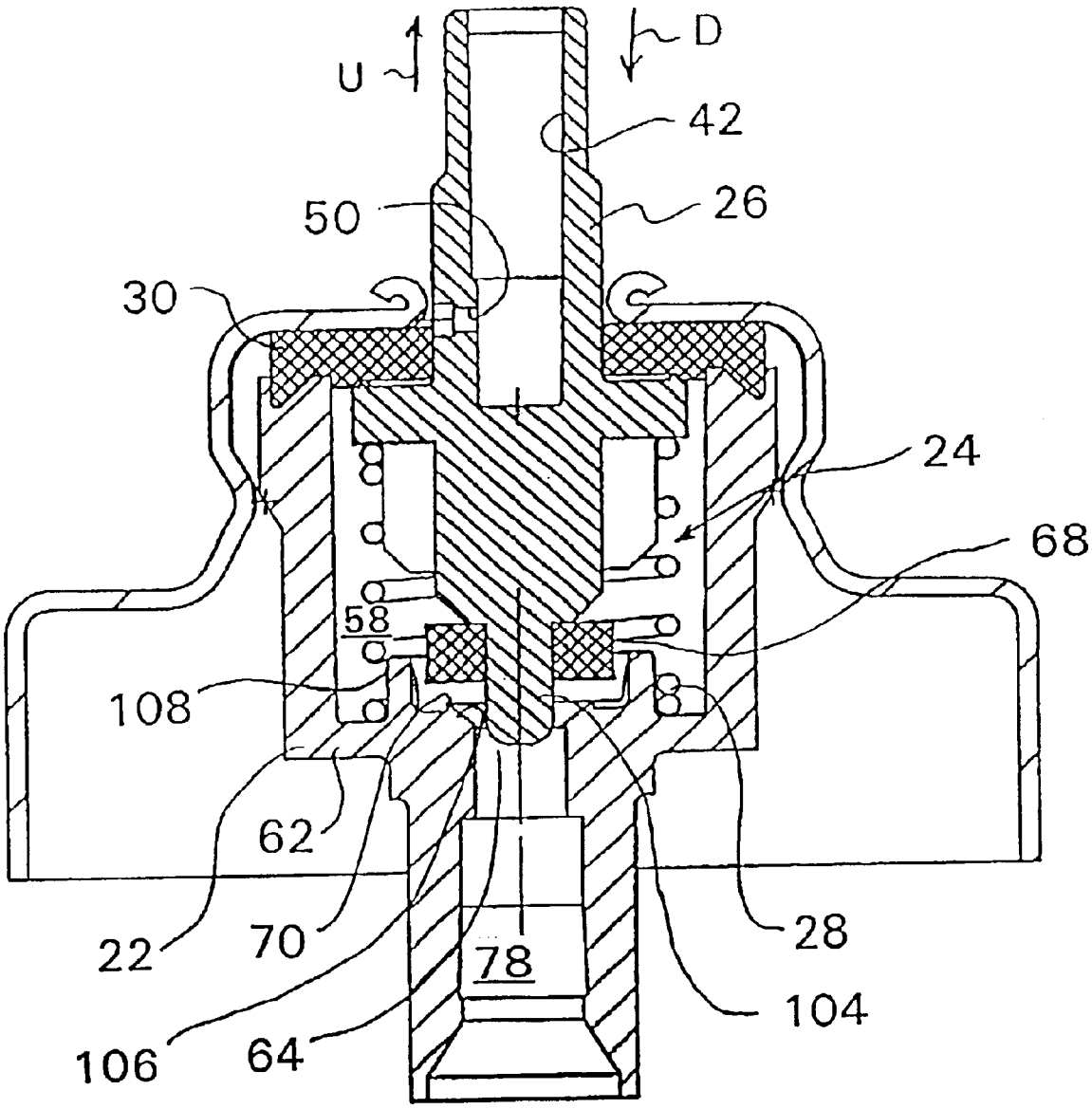
FIG. 11 is a diagrammatic cross-sectional view showing a further variation of the metering valve assembly of FIG. 2.

With reference to FIG. 11, a further modification to the embodiment of FIG. 1 will now be discussed. As this embodiment is very similar to the first embodiment, the same element are given the same reference numerals but a detailed description concerning only the differences between this embodiment and the first embodiment will be provided.

As with the first embodiment, the metering valve assembly 10 comprises a valve housing 22 having an internal cavity 24 which supports a lower portion of an upstanding valve stem 26, a compression spring 28, a compressible sealing member 68 and an annular sealing edge 70. However, the arrangement of the lower portion of the valve stem 26, the compression spring 28, the compressible sealing member 68 and annular sealing edge 70 are modified. According to this embodiment, the lower downwardly extending tip portion 104 of the valve stem 26 is cylindrical in shape and supports the compressible sealing member 68, for example, via an interference fit between a central aperture formed in the compressible sealing member 68 and the exterior cylindrical surface of the lower downwardly extending tip portion of the valve stem 26. Preferably, a leading end of the tip portion 104 of the valve stem 26 is semispherical in shape and located to be received within the inlet 64 of the valve housing 22. Due to this arrangement, the valve stem 26 cooperates with the inlet 64 of the valve housing 22 to prevent the compressible sealing member 68 from inadvertently becoming dislodged or separated from the valve stem 26 during operation of the valve.

The opening of the inlet 64 tapers toward a smaller opening and this taper forms a valve seat 106. The annular sealing edge 70 is formed integral with and circumscribes the valve seat 106 of the inlet 64. According to this embodiment, the annular sealing edge 70 does not protrude or extend away from the base wall 62 as much as the embodiment of FIG. 2. An upwardly directed or extending sleeve 108 is formed integral with a base wall 62 of the valve housing 22 and circumscribes both the annular sealing edge 70 and the valve seat 106 of the inlet 64. The upwardly directed or extending sleeve 108 confines the reconfiguration, expansion and/or radial movement of the compressible sealing member 68 during compression thereof by the valve stem 26. A first end of the compression spring 28 completely circumscribes the sleeve, the annular sealing edge 70 and the valve seat 106 while a second end of the compression spring 28 mates with and is centered by an undersurface of the annular flange 66 of the valve stem 26.

As with the previous embodiments, the annular sealing edge 70 engages with the sealing member 68, once the valve stem 26 is sufficiently depressed, to divide, separate or partition the valve housing 22 into two separate chambers, namely, a metering chamber 58 and a filling chamber 78. However, according to this embodiment, the entire internal cavity 24 is partitioned off to form the metering chamber 58 while the inlet 64 to the valve housing 22 comprises the filling chamber 78. Due to this arrangement, when the valve stem 26 is sufficiently depressed in the direction of arrow D, the valve stem 26 at first partially compresses the spring 28 and moves the compressible sealing member 68 into an abutting engagement with the annular sealing edge 70. Once the compressible sealing member 68 and the annular sealing edge 70 are sufficiently engaged with one another, the flow of further product to be dispensed into the metering chamber 58 is prevented.

Upon further depression of the valve stem 26 in the direction of arrow D, the degree of engagement between the compressible sealing member 68 and the annular sealing edge 70 increases, the compressible sealing member 68 seals against the valve seat 106, and the at least one radial passageway(s) 50 eventually ceases to be sealed by the valve gasket 30 so that substantially all of the product, contained within the metering chamber 58, is permitted to flow radially inwardly, through the at least one radial passageway(s) 50, and axially along the central passageway 42 of the valve stem 26 to the actuator (not shown in this Figure) and be dispensed by the actuator into the surrounding environment. Once the pressure within the metering chamber 58 becomes essentially atmospheric, no further product is able to be dispensed from the metering chamber 58.

When the applied depression force is removed, the valve stem 26 is biased, due to the action of the compression spring 28, in the direction of arrow U into its closed position. As this occurs, the fluid communication between the metering chamber 58 and the at least one radial passageway(s) 50 is first interrupted. Further movement of the valve stem 26, in a direction of arrow U, re-establishes communication between the filling chamber 78 and the metering chamber 58 so that the product to be dispensed is again allowed to flow through the dip tube (not shown in this Figure) into the internal cavity 24 of the valve housing 22 and replenish the dispensed supply of product contained within the metering chamber 58.

Preferably the valve stem 26 is manufactured from nylon, for example, while the compressible sealing member 68 is manufactured from an olefin based thermo elastomer, for example. Due to this selection of the materials, the compressible sealing member 68 is capable of chemically bonding with the valve stem 26 thereby avoiding the need to mechanically bond the compressible sealing member 68 to the valve stem 26.

The term "ferrule" as used throughout the specification and in the following claims, is interchangeable with the term "mounting cup" and is to be construed in such manner.

Since certain changes may be made in the above described improved metering valve assembly, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A metering valve assembly comprising:

a ferrule having an aperture formed therein;

a valve housing having an inlet provided in a wall thereof, the valve housing defining an internal cavity which accommodates an annular flange of a valve stem and a compression spring therein, and a valve gasket closing the internal cavity;

the valve housing being attached to the ferrule such that a stem portion of the valve stem protrudes through an aperture provided in the valve gasket and through the aperture provided in the ferrule;

the ferrule having a ferrule gasket for sealingly engaging with an opening of a container to form a fluid tight seal therewith, the ferrule gasket having a through hole therethrough with at least one passage being formed between the ferrule gasket and the valve housing to facilitate passage of a desired propellent and product to be dispensed during a conventional filling process; and the stem portion having a central passageway formed therein communicating with a dispensing outlet of the metering valve assembly, and an opposite end of the central passageway communicating with at least one radial passageway; and the at least one radial passageway being normally closed by the valve gasket due to the spring normally biasing the valve stem into a closed position;

wherein one of an undersurface of the annular flange of the valve stem and a mating surface of the valve housing is provided with a compressible sealing member and the other of the undersurface of the valve stem and the mating surface of the valve housing has an annular edge protruding axially therefrom and the compressible sealing member and the annular edge, when the valve stem is sufficiently depressed, engage with one another to form a seal therebetween to partition the interior cavity into a metering chamber and a separate filling chamber so that product may be dispensed only from the metering chamber when a product flow path is established between the metering chamber and the dispensing outlet of the valve stem.

2. The metering valve assembly according to claim 1, wherein a first end of a dip tube is coupled to the inlet of the valve housing to facilitate conveying product from an aerosol container into the interior cavity of the valve housing and the annular edge protrudes axially from one of the undersurface of the valve stem and the mating surface of the valve housing by at least about 1/16 of an inch.

3. The metering chamber according to claim 1, wherein an actuator is attached to a remote end of the valve stem to facilitate dispensing of the product from the dispensing outlet of the metering valve assembly.

4. The metering valve assembly according to claim 1, wherein the compressible sealing member has a diameter of between about 0.20 of an inch and about 0.30 of an inch and has a thickness of between 0.045 of an inch and 0.070 of an inch and, when the valve stem is depressed toward a base of the valve housing, the annular edge engages with and axially compresses the compressible sealing member and reduces a axial thickness of the compressible sealing member.

5. The metering valve assembly according to claim 1, wherein the annular edge has a diameter of between about 0.18 of an inch and about 0.25 of an inch and has a height of between about 1/32 of an inch and about 1/16 of an inch and a lower portion of the metering chamber is concentric and surrounds an upper portion of the filling chamber, and the diameter of the annular edge is smaller than a diameter of the compressible sealing member.

6. The metering valve assembly according to claim 1, wherein the metering chamber defines volume between 30 microliters and 300 microliters and, when the valve stem is sufficiently depressed, an inwardly facing surface of the annular edge faces and communicates with the filling chamber and an outwardly facing surface of the annular edge faces and communicates with the metering chamber.

7. The metering valve assembly according to claim 1, wherein the at least one radial passageway is sealed by the valve gasket until the valve stem of the metering valve assembly is in its open position whereby the valve gasket only allows product to flow into the at least one radial passageway once the compressible sealing member and the annular edge partition the interior cavity into the metering chamber and the filling chamber.

8. The metering valve assembly according to claim 1, wherein the compressible sealing member is sealingly compressed prior to any product being dispensed from the metering chamber through the at least one radial passageway and out the discharge outlet of the metering valve assembly to prevent inadvertent throttling of the metering valve assembly.

9. The metering valve assembly according to claim 1, in combination with a container having an opening therein, and the ferrule gasket sealingly engages with the opening of the container to form a fluid tight seal, between the ferrule and the opening of the container, and form an aerosol container.

10. The metering valve assembly according to claim 1, wherein a base wall of the valve housing has the inlet formed therein, and a first end of a dip tube is received by the inlet, and the dip tube facilitates conveying the product to be dispensed into the interior cavity of the valve housing.

11. The metering valve assembly according to claim 1, wherein the annular flange has an annular rib and the spring normally biases the annular rib of the annular flange into sealing engagement with the valve gasket to provide a fluid tight seal therebetween and maintain the metering valve assembly in a normally closed position.

12. The metering valve assembly according to claim 1, wherein the metering valve assembly further includes an actuator button having a product inlet which receives and fits over an exterior surface of the stem portion of the valve stem, and the product inlet communicates with the dispensing outlet via the at least one radial passageway, and an annular wall supports and spaces the annular edge axially from one of the undersurface of the valve stem and the mating surface of the valve housing.

13. The metering valve assembly according to claim 1, wherein the at least one radial passageway has a cross-sectional dimension of between about 0.011 and 0.040 inches, and the annular edge and the compressible sealing member are both located between the annular flange of the valve stem and a base of the valve housing, and upon initial actuation of the metering valve assembly, the annular flange is moved toward the base of the valve housing so that the annular edge initially engages with and initially axially compresses an annular area of the compressible sealing member, and, upon further actuation of the metering valve assembly so as to establish product flow between the metering chamber and the dispensing outlet, the annular edge further axially compresses the same annular area of the compressible sealing member.

14. A metering valve assembly comprising:

a ferrule having an aperture formed therein;

a valve housing having an inlet provided in a wall thereof, the valve housing defining an internal cavity which accommodates an annular flange of a valve stem and a compression spring therein, and a valve gasket closing the internal cavity;

the valve housing being attached to the ferrule such that a stem portion of the valve stem protrudes through an aperture provided in the valve gasket and through the aperture provided in the ferrule;

the ferrule having a ferrule gasket for sealingly engaging with an opening of a container to form a fluid tight seal therewith, the ferrule gasket having a through hole therethrough with at least one passage being formed between the ferrule gasket and the valve housing to facilitate passage of a desired propellent and product to be dispensed during a conventional filling process; and the stem portion having a passageway formed therein communicating with a dispensing outlet of the metering valve assembly, and an opposite end of the passageway communicating with at least one radial passageway: and the at least one radial passageway being normally closed by the valve gasket due to the spring normally biasing the valve stem into a closed position;

wherein one of an undersurface of the annular flange of the valve stem and a mating surface of the valve housing is provided with a compressible sealing member and the other of the undersurface of the valve stem and the mating surface of the valve housing has an annular edge, which axially extends therefrom and the compressible sealing member and the annular edge, when the valve stem is sufficiently depressed, form a seal therebetween to partition the interior cavity into a metering chamber and a separate filling chamber so that product may be dispensed only from the metering chamber when a product flow path is established between the metering chamber and the dispensing outlet of the valve stem; and the undersurface of the annular flange of the valve stem supports the compressible sealing member, and the compressible sealing member is integrally molded with the annular flange, during a second step of the molding process.

15. The metering valve assembly according to claim 1, wherein the compressible sealing member is manufactured from one of rubber, an elastomeric material, a gasket material and a seal material and the annular edge protrudes axially from one of the undersurface of the valve stem and the mating surface of the valve housing by a distance of between about 1/32 and about 1/16 of an inch.

16. The metering valve assembly according to claim 1, wherein the through hole has three generally flat surfaces and three sections, the three generally flat surfaces of the ferrule gasket compressively engage with an exterior surface of the valve housing to fasten the ferrule gasket thereto while the three sections of the through hole remain spaced from the valve housing to form three spaced apart product flow passageways between the ferrule gasket and the valve housing to facilitate passage of a desired propellent and product to be dispensed during the conventional filling process.

17. The metering valve assembly according to claim 1, wherein one of the annular flange and a side wall of the valve housing includes a component which ensures that the compressible sealing member, during compression thereof by the valve stem, is prevented from completely sealing with the valve housing during depression of the valve stem.

18. A method of metering dispensing of product through a metering valve assembly, the method comprising the steps of:

forming an aperture in a ferrule;

providing an inlet in a wall of a valve housing and defining, via the valve housing, an internal cavity which accommodates an annular flange of a valve stem and a compression spring therein, and closing the internal cavity with a valve gasket;

attaching the valve housing to the ferrule such that a stem portion of the valve stem protrudes through an aperture provided in the valve gasket and through the aperture provided in the ferrule;

providing the ferrule with a ferrule gasket for sealingly engaging with an opening of a container to form a fluid tight seal therewith, the ferrule gasket having a through hole therethrough with at least one passage being formed between the ferrule gasket and the valve housing to facilitate passage of a desired propellent and product to be dispensed during a filling process;

forming a central passageway in the stem portion which communicates with a dispensing outlet of the metering valve assembly, while an opposite end of the central passageway communicates with at least one radial passageway; and normally closing the at least one radial passageway with the valve gasket due to the spring normally biasing the valve stem into a closed position;

providing one of an undersurface of the annular flange of the valve stem and a mating surface of the valve housing with a compressible sealing member and providing the other of the undersurface of the valve stem and the mating surface of the valve housing with an annular wall supporting and spacing an annular edge axially therefrom; and forming a seal between the compressible sealing member and the annular edge by engaging the compressible sealing member with the annular edge when the valve stem is sufficiently depressed, to partition the interior cavity into a metering chamber and a separate filling chamber, so that product may be dispensed only from the metering chamber when a product flow path is established between the metering chamber and the dispensing outlet of the valve stem.

19. The method according to claim 18, further comprising the steps of integrally molding the compressible sealing member with the undersurface of the annular flange of the valve stem during a second step of the molding process; and forming the through hole with three generally flat surfaces and three sections, the three generally flat surfaces of the ferrule gasket compressively engage with an exterior surface of the valve housing to fasten the ferrule gasket thereto while the three sections of the through hole remain spaced from the valve housing to form three spaced apart product flow passageways between the ferrule gasket and the valve housing to facilitate passage of a desired propellent and product to be dispensed during the filling process.

20. The valve assembly combination according to claim 1, wherein the annular wall supports and spaces the annular edge axially from one of the undersurface of the valve stem and the mating surface of the valve housing.

* * * * *